US005732643A

United States Patent [19]

Neuhaus

[11] Patent Number: 5,732,643

[45] Date of Patent: Mar. 31, 1998

[54] SAIL FOR WIND-POWERED CONVEYANCES

[76] Inventor: Dietmar Neuhaus, Kaiserslauternerstr. 32, 40591 Duesseldorf, Germany

[21] Appl. No.: 718,433

[22] PCT Filed: Apr. 20, 1995

[86] PCT No.: PCT/DE95/00542

§ 371 Date: Sep. 30, 1996

§ 102(e) Date: Sep. 30, 1996

[87] PCT Pub. No.: WO95/29841

PCT Pub. Date: Nov. 9, 1995

[30] Foreign Application Priority Data

Apr. 29, 1994 [DE] Germany ..... 44 15 070.9

[51] Int. Cl.[6] ..... B63H 9/04

[52] U.S. Cl. ..... 114/103; 114/39.2

[58] Field of Search ..... 114/39.1, 39.2, 114/102, 103, 104

[56] References Cited

U.S. PATENT DOCUMENTS 4,437,426 3/1984 Latham ..... 114/103

FOREIGN PATENT DOCUMENTS 4229443 3/1994 Germany ..... 114/103

*Primary Examiner*—Jesus D. Sotelo

*Attorney, Agent, or Firm*—Diller, Ramik & Wight, PC

[57] ABSTRACT

A sail includes a headsail and a mainsail each having leading and trailing edge portions with the headsail trailing edge portion being disposed adjacent the mainsail leading edge portion. The headsail is pivotable relative to the mainsail and is restricted in such relative pivoting movement. The headsail is defined by a plurality of headsail segments separated by gaps in at least selective ones of which is a batten extending substantially between the headsail and the mainsail. A covering preferably in the form of a bracing band of sheet material or fabric material covers an associated gap. Each bracing band is defined by a bight band portion embracing the headsail leading edge portion and leg band portions being secured to opposite sides of the main sail leading edge portion.

21 Claims, 2 Drawing Sheets

SAIL FOR WIND-POWERED CONVEYANCES

BACKGROUND OF THE INVENTION

The invention relates to a sail for wind-powered conveyances, particularly surfboards, formed of at least one fabric or sheet web extended between a leading edge and a trailing edge.

The aerodynamic efficiency of simple sails which only consist of stretched fabric or sheet webs can be improved by a series of measures.

It is known that the aerodynamic profile of a sail and particularly that of a surf sail can be stabilized by battens of which at least some extend from the leading edge to the trailing edge of the sail. Because of the battens, changing wind pressure changes the profile depth of the sail only slightly. Thereby, its pressure center stability is increased.

From OS DE 4229443 A1, a slotted sail is known, which, as to its effect, is comparable to a slotted wing from aircraft construction. The slotted sail consists of a headsail and a mainsail. The headsail is pivotable about the leading edge of the sail in an angular range so that a gap is created between the trailing edge of the headsail and the leading edge of the mainsail. The angular range is predetermined by bracings encompassing the headsail and mounted to the mainsail.

SUMMARY OF THE INVENTION

It is the object of the invention to combine the features of a sail with battens with the features of a slotted sail in a novel sail so that an aerodynamically advantageous sail is created.

This object is solved, according to the invention, by the fact that the novel sail is configured as a slotted sail according to OS DE 4229443 A1, consisting of a headsail and a mainsail, with a headsail assembled of headsail segments, and battens extending to the leading edge of the sail along the separation gap between the segments of the headsail.

Due to the fact that, according to the invention, the headsail is assembled of headsail segments, each headsail segment comprising the substantial features of the headsail of OS DE 4229443 A1, as pivotability about the leading edge of the sail and restriction of the pivot range of the headsail by suitable means, the headsail can pivot past the battens extending to the leading edge of the sail.

In the region of the leading edge of the sail, the headsail segments can be interconnected.

Advantageously, the separation gap between the headsail segments is covered by a bracing band of fabric or sheet material. Near the leading edge of the mainsail, the bracing band is connected to the mainsail, laid about the leading edge of the sail, led back to the mainsail and mounted there again. The width of the bracing band is appropriately chosen so that the bracing band does not impede pivot movements of the headsail elements about the leading edge of the sail.

It is particularly advantageous, because it is aerodynamically favorable, to configure the leading edge of the sail in a rounded shape. As is common with surf sails, the leading edge of the sail may be a mast. In this case, the battens leading to the leading edge of the sail are advantageously supported on the mast.

BRIEF DESCRIPTION OF THE DRAWINGS

The surf sail in FIG. 1 consists of a headsail (1) and a mainsail (2). The headsail is composed of 6 headsail segments (3). In one of the headsail elements (3), the opening (4) for the wishbone boom is incorporated. Five bracing bands (5) are laid about the mast (6) and mounted to the mainsail (2). The battens (7) extend from the leading edge to the trailing edge of the surf sail.

Figure 1:
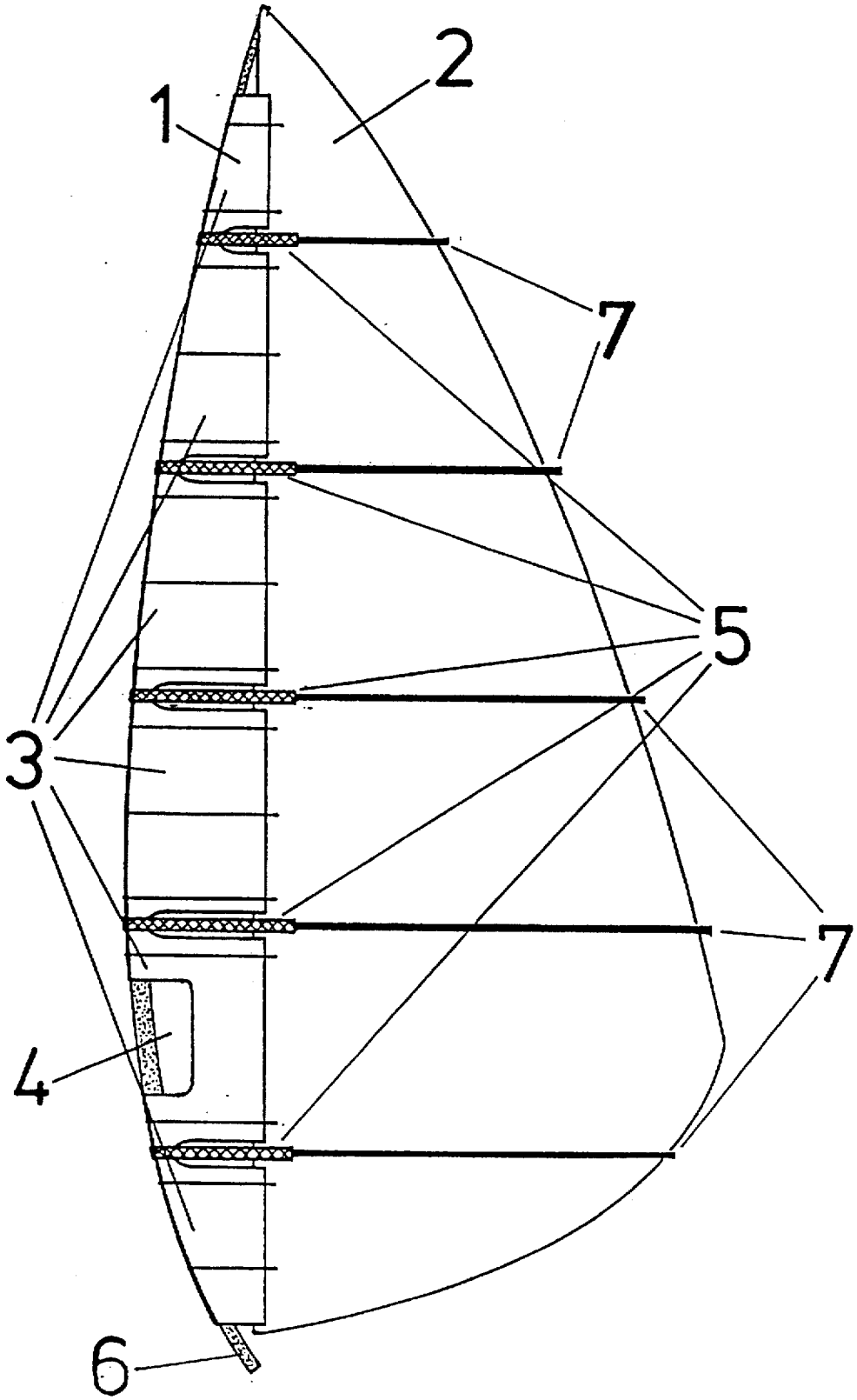
Figure 2:
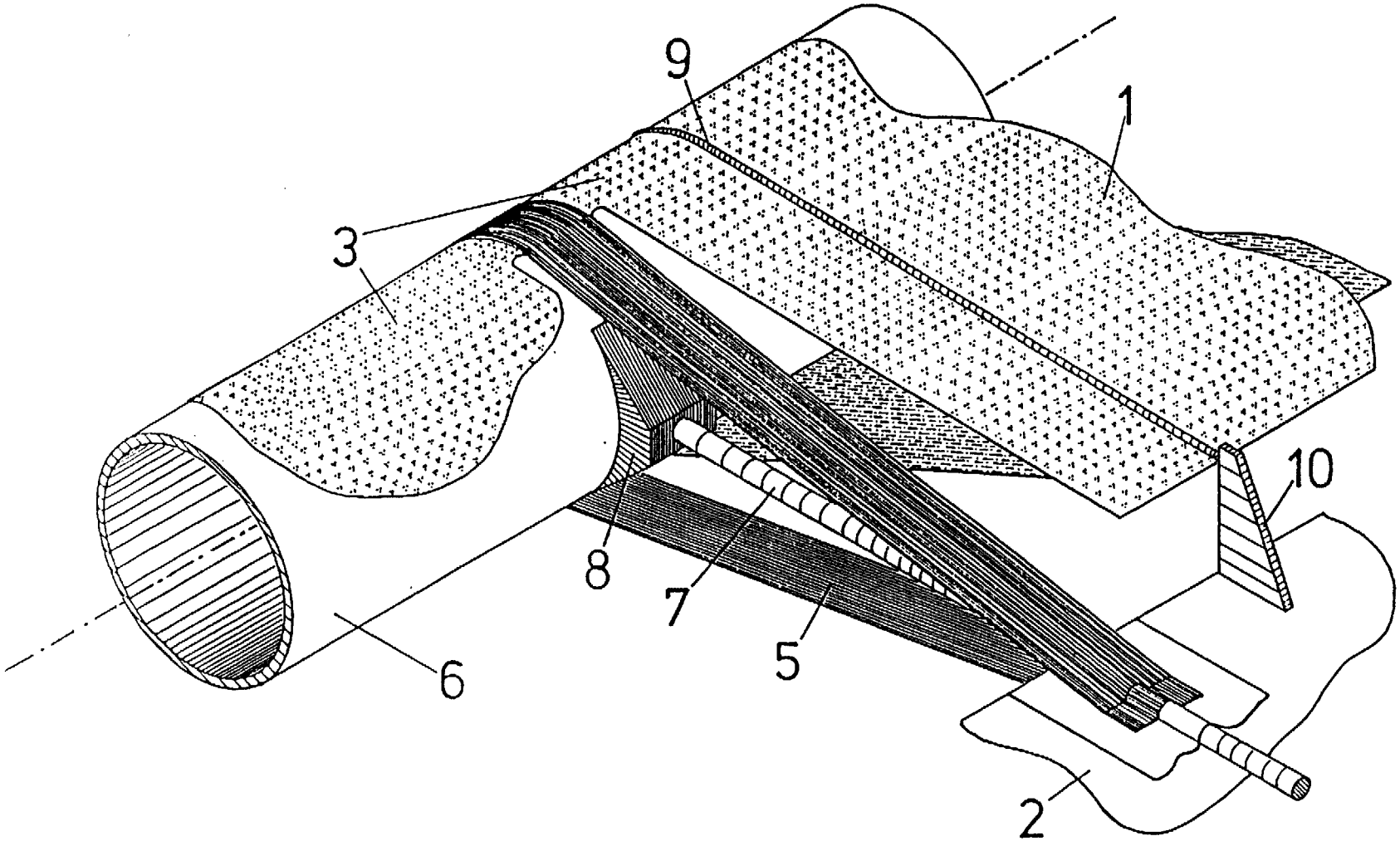
In FIG. 2, a part of the leading edge of the surf sail is illustrated. Two headsail segments (3) are partially pictured. The separation gap between the headsail segments (3) is covered by a bracing band (5). The bracing band (5) is laid around the leading edge of the sail, a mast (6) in this case, and mounted to the mainsail (2). Via an adapter (8), the batten (7) is supported on the mast (6). The bracing (9) and the spacer (10) restrict the pivot range of the headsail segment (3).

What is claimed is:

1. A sail comprising a headsail and a mainsail, said headsail including leading and trailing edge portions, said mainsail including leading and trailing edge portions, said headsail trailing edge portion being disposed adjacent said mainsail leading edge portion, said headsail being pivotable relative to said mainsail, means for restricting the pivotal movement of said headsail relative to said mainsail, said headsail being defined by a plurality of headsail segments, a gap between adjacent headsail segments, a plurality of battens, each batten being located at an associated gap extending substantially between said headsail and said mainsail, and means for at least partially covering selected ones of said gaps.

2. The sail as defined in claim 1 wherein said covering means is a bracing band of sheet material associated with each gap.

3. The sail as defined in claim 1 wherein said covering means is a bracing band of fabric material associated with each gap.

4. The sail as defined in claim 1 including a mast at said headsail leading edge portion.

5. The sail as defined in claim 1 wherein each batten extends substantially between the headsail and the mainsail leading edge portion.

6. The sail as defined in claim 1 wherein said covering means is a bracing band of sheet material associated with each gap, said bracing band being defined by a bight band portion merging with a pair of leg band portions, said bight band portion being in embracing relationship to said headsail leading edge portion, and said leg band portions being secured to said mainsail.

7. The sail as defined in claim 1 wherein said covering means is a bracing band of sheet material associated with each gap, said bracing band being defined by a bight band portion merging with a pair of leg band portions, said bight band portion being in embracing relationship to said headsail leading edge portion, and said leg band portions being secured to said mainsail leading edge portion.

8. The sail as defined in claim 1 wherein said restricting means includes a spacer carried by and projecting transversely from at least one side of said mainsail leading edge portion, and an abutment member extending between said spacer and said headsail leading edge portion against which said headsail can abut to restrict the pivotal movement thereof.

9. The sail as defined in claim 1 wherein said covering means is a bracing band of sheet material associated with each gap, said bracing band being defined by a bight band portion merging with a pair of leg band portions, said bight band portion being in embracing relationship to said headsail leading edge portion, and said leg band portions being secured to said mainsail with said mainsail leading edge portion being sandwiched between said pair of leg band portions.

10. A sail comprising a headsail and a mainsail, said headsail including leading and trailing edge portions, said mainsail including leading and trailing edge portions, said headsail trailing edge portion being disposed adjacent said mainsail leading edge portion, said headsail being pivotable relative to said mainsail, means for restricting the pivotal movement of said headsail relative to said mainsail, said headsail being defined by a plurality of headsail segments, a gap between adjacent headsail segments, a plurality of battens, each batten being located at an associated gap extending substantially between said headsail and said mainsail, and means for at least partially covering selected ones of said gaps extending substantially between said headsail leading edge portion and said mainsail leading edge portion.

11. The sail as defined in claim 10 wherein said covering means is a bracing band of sheet material associated with each gap.

12. The sail as defined in claim 11 wherein said covering means is a bracing band of fabric material associated with each gap.

13. The sail as defined in claim 11 wherein each batten extends substantially between the headsail and the mainsail leading edge portion.

14. The sail as defined in claim 11 wherein said covering means is a bracing band of sheet material associated with each gap, said bracing band being defined by a bight band portion merging with a pair of leg band portions, said bight band portion being in embracing relationship to said headsail leading edge portion, and said leg band portions being secured to said mainsail.

15. The sail as defined in claim 11 wherein said covering means is a bracing band of sheet material associated with each gap, said bracing band being defined by a bight band portion merging with a pair of leg band portions, said bight band portion being in embracing relationship to said headsail leading edge portion, and said leg band portions being secured to said mainsail leading edge portion.

16. The sail as defined in claim 11 wherein said restricting means includes a spacer carried by and projecting transversely from at least one side of said mainsail leading edge portion, and an abutment member extending between said spacer and said headsail leading edge portion against which said headsail can abut to restrict the pivotal movement thereof.

17. The sail as defined in claim 10 wherein said covering means is a bracing band of fabric material associated with each gap.

18. The sail as defined in claim 10 wherein each batten extends substantially between the headsail and the mainsail leading edge portion.

19. The sail as defined in claim 10 wherein said covering means is a bracing band of sheet material associated with each gap, said bracing band being defined by a bight band portion merging with a pair of leg band portions, said bight band portion being in embracing relationship to said headsail leading edge portion, and said leg band portions being secured to said mainsail.

20. The sail as defined in claim 10 wherein said covering means is a bracing band of sheet material associated with each gap, said bracing band being defined by a bight band portion merging with a pair of leg band portions, said bight band portion being in embracing relationship to said headsail leading edge portion, and said leg band portions being secured to said mainsail leading edge portion.

21. The sail as defined in claim 10 wherein said restricting means includes a spacer carried by and projecting transversely from at least one side of said mainsail leading edge portion, and an abutment member extending between said spacer and said headsail leading edge portion against which said headsail can abut to restrict the pivotal movement thereof.

* * * * *